United States Patent [19]

Grenfell et al.

[11] 4,113,469

[45] Sep. 12, 1978

[54] REFINING MOLTEN METAL

[75] Inventors: Hugh W. Grenfell; David J. Bowen, both of Swansea, Wales; Robert Baker, Sheffield, England

[73] Assignee: British Steel Corporation, Great Britain

[21] Appl. No.: 792,602

[22] Filed: May 2, 1977

[30] Foreign Application Priority Data

Apr. 30, 1976 [GB] United Kingdom ..... 17724/76

[51] Int. Cl.[2] ..... C21C 5/30

[52] U.S. Cl. ..... 75/60; 75/59; 75/82

[58] Field of Search ..... 75/59, 60

[56] References Cited

U.S. PATENT DOCUMENTS

| | | | |
|---|---|---|---|
| 3,046,107 | 7/1962 | Nelson | 75/59 |
| 3,594,155 | 7/1971 | Ramachordran | 75/60 |
| 3,773,497 | 11/1973 | Grenfell | 75/60 |
| 3,816,720 | 6/1974 | Bauer | 75/60 |
| 3,850,617 | 11/1974 | Umowski | 75/60 |
| 3,930,843 | 1/1976 | Fruehan | 75/60 |

*Primary Examiner*—P. D. Rosenberg

*Attorney, Agent, or Firm*—Bacon & Thomas

[57] ABSTRACT

A method is provided for refining molten metal containing an impurity which is oxidizable in preference to one or more selected constituent elements of the metal and which forms a gaseous oxide, the method comprising injecting oxygen and a diluent gas into the molten metal contained in a vessel so as to reduce the proportion of the impurity in the metal by evolution as the gaseous oxide, weighing the vessel during refining to establish a point at which the weight of the vessel contents changes significantly due to preferential oxidation of the one or more selected constituent elements, initiating at the point a reduction in the ratio of oxygen: diluent gas to as to reduce the rate of oxidation of the one or more selected constituent elements relative to the impurity and continuing injection until the proportion of the impurity is reduced to the desired level.

16 Claims, 3 Drawing Figures

REFINING MOLTEN METAL

Figure 1:
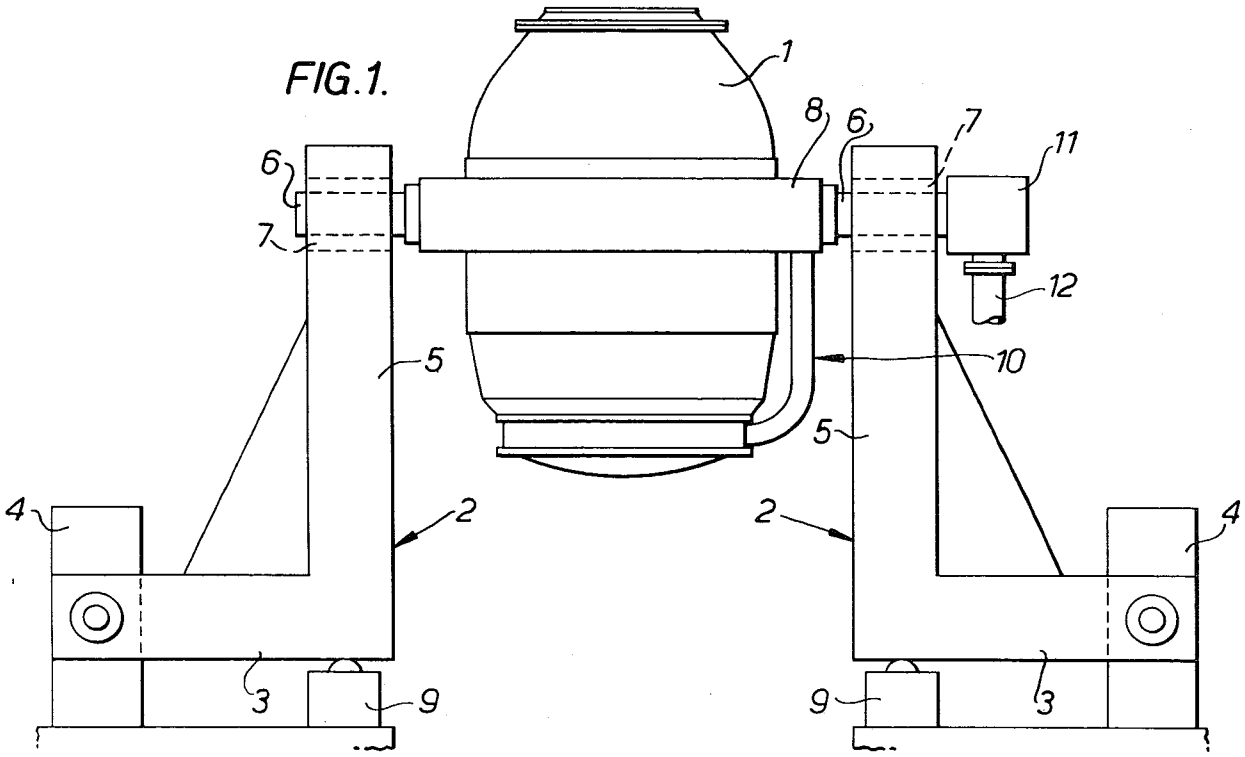

This invention relates to the refining of molten metal and is particularly concerned with the refining of alloy melts.

Alloy melts such as stainless steel melts and other highly alloyed materials such as nickel superalloys are currently produced by a duplex process involving melting the basic cold charge in an electric arc furnace and in the case of stainless steel adding chromium as high carbon ferrochrome and decarburising the liquid steel in a converter vessel. The decarburisation is performed by injecting a stream of oxygen and diluent gas either singly or combined into the metal held within the vessel.

The oxygen and the diluent gas may be injected in varying modes. For instance the oxygen and the diluent gas may be injected as a mixture either through the bottom or the side of the vessel. This is the basis of the A.O.D process developed by Union Carbide Corporation, the diluent gas in this case being either argon or nitrogen. In the C.L.U. process developed by Creusot Loire/Uddeholm the gas mixture is oxygen and steam. In other processes the oxygen is injected through the top of the vessel and the diluent gas in the form of an inert gas or mixture of inert gases is injected through the bottom or side wall of the vessel as described in U.K. Patent Application No. 25449/74. These processes generally operate over a series of stages in which the volume gas ratio of oxygen: diluent gas is successively reduced as the carbon content in the melt is lowered in order to reduce oxidation of chromium, iron and other metals while maintaining removal of carbon from the melt as a gaseous oxide.

For instance in one procedure the refining of the charge is begun with the ratio set at 3:1 or greater. This ratio is maintained for a period determined by the initial hot metal composition. When the carbon content has reached approximately 0.3% C the ratio is reduced to 2:1 and the ratio is reduced again to 1:2 when the carbon content has reached 0.1%. The melt is then finally refined to a desired low carbon level. It has been found that this procedure enables chromium oxidation to be kept at a minimum while allowing carbon removal to be kept at a maximum.

In each of these processes in order to achieve maximum economies in terms of minimum expensive diluent gas usage, minimum chromium and other alloy oxidation, minimum usage of ferrosilicon reductant to recover chromium from the slag, minimum process time and minimum refractory consumption, it is advantageous to be able to monitor the composition changes occurring in the melt throughout the blow in order to select optimum input gas ratios. If the relative rates of oxidation of carbon and chromium can be assessed throughout refining, the oxygen: diluent gas ratios can be changed without process interruption and over a wide range in order to control the oxidation of carbon and chromium.

One method by which carbon removal rate is currently monitored involves the use of waste gas composition and flow rate measurements in the waste gas duct. The instantaneous carbon content of the melt is calculated by difference knowing the quantity of carbon in a sample taken from the initial liquid metal charge and the integrated quantity of carbon removed in the waste gas. However, this method has not been used widely on production plants because the basic design of most of the waste gas extraction systems of such plants incorporates a full combustion — full dilution collecting hood in order to cool the waste gases to a temperature at which they can be readily used in a simple non water cooled, non — refractory lined system. This is done by diluting the waste gas in the duct with air and the result is that frequently the level of carbon dioxide in the diluted gas is so low that determination of decarburisation rate is inaccurate.

Another method for determining the carbon removal rate is the sampling of waste gases from within the vessel itself and prior to dilution by entrained air. This method however requires the introduction into the vessel of a water-cooled gas sampling probe of sophisticated design. This probe requires careful handling and maintainance to work reliably in the arduous steelmaking environment and this is not possible in most cases. Further disadvantages of the use of methods based on waste gas analysis for controlling and inhibiting chromium oxidation are that the rate of chromium oxidation cannot be measured directly nor can the relative rates of oxidation of carbon, chromium and/or other metallic elements be measured directly. It is essential to correlate carbon removal rate with metal temperature, reactive gas input rate and chromium oxidation rate before a satisfactory gas ratio point can be selected.

A further method for determining the rate of decarburisation is simple chemical analysis of samples removed from the melt at varying intervals during refining. This is more accurate than the above methods as the rates both of carbon and chromium oxidation can be measured directly but has the disadvantage that there is a delay between the point at which the sample is taken and the point at which the analysis is available so that control action in response to the analysis is also necessarily delayed.

It is therefore an object of the present invention to provide a method overcoming the disadvantages inherent in the above methods.

According to one aspect of the present invention a method is provided for refining molten metal containing an impurity which is oxidisable in preference to one or more selected constituent elements of the metal and which forms a gaseous oxide, the method comprising injecting oxygen and a diluent gas into the molten metal contained in a vessel so as to reduce the proportion of the impurity in the metal by evolution as the gaseous oxide, weighing the vessel during refining to establish a point at which the weight of the vessel contents changes significantly due to preferential oxidation of the one or more selected constituent elements, initiating at the point a reduction in the ratio of oxygen: diluent gas so as to reduce the rate of oxidation of the one or more selected constituent elements relative to the impurity and continuing injection until the proportion of the impurity is reduced to the desired level.

The significant change in the weight of the vessel contents may take the form of a significant inflexion in the shape of a curve recording the weight of the vessel contents. The significant change in the weight of the vessel contents may be more clearly established from a determination of the rate at which the weight of the vessel contents is changing.

Preferably the vessel is weighed continuously during refining and suitably during refining the reduction in the ration of oxygen: diluent gas is continued as one or more further points representative of significant changes in the weight of the vessel contents are established. Conveniently the reduction is continued until a final ratio is achieved. The object in this case is to maximise the rate of oxidation of the impurity element and minimise the oxidation of the one or more constituent elements.

The molten metal may be an alloy of, for example, high chromium iron destined to become stainless steel in which the impurity is carbon and the one selected constituent element is chromium. In this case the reduction in the ratio of oxygen: diluent gas may be performed in two stages corresponding to two points at which sharp increases in the weight of the vessel contents are found to occur. Preferably the initial ratio is at least 3:1 and is reduced in the first stage to an intermediate ratio of 2:1. In the second stage the ratio may be reduced from 2:1 to a final ratio of 1:2. The initial ratio may be held constant during the initial refining period until the occurrence of the first point at which a significant change occurs in the weight of the vessel contents.

Figure 2:
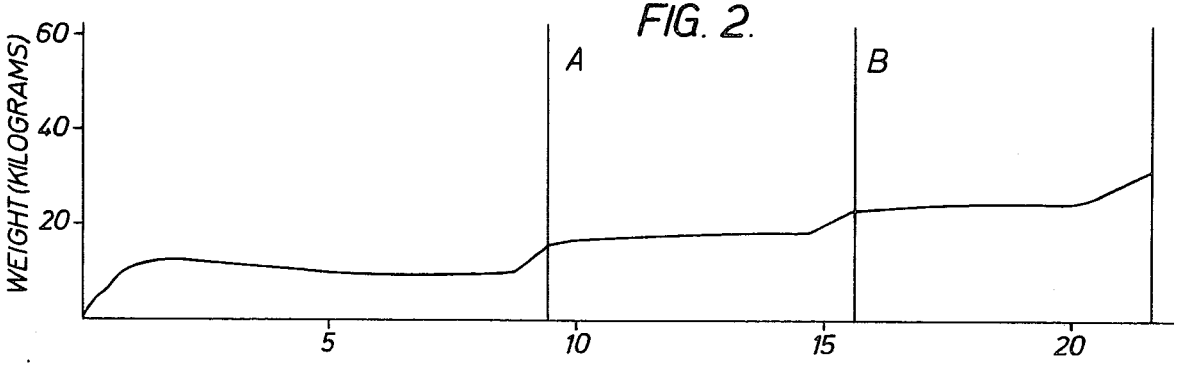
Figure 3:
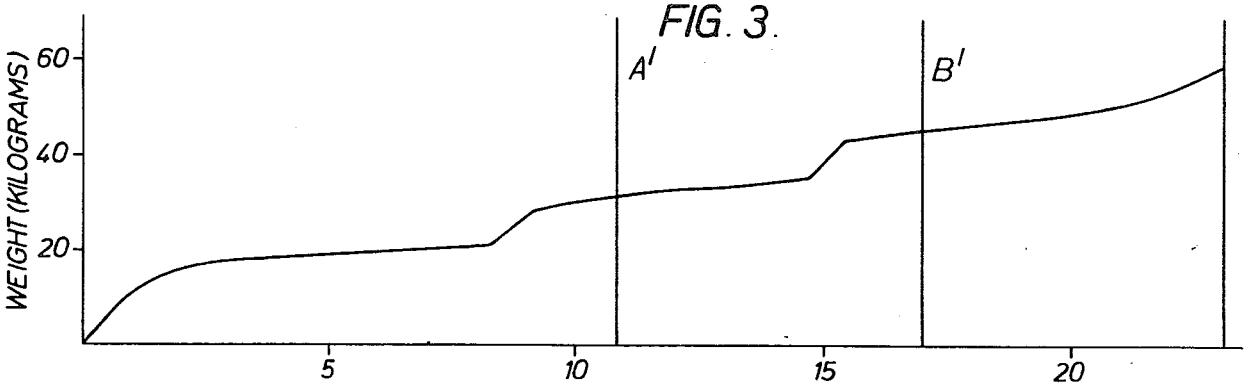

Preferably the diluent gas is one or a mixture of inert gases. Suitably the inert gas is argon, nitrogen or steam. An embodiment of the invention will now be particularly described with reference to the accompanying drawings in which:

FIG. 1 is a side view of a converter vessel mounted for weighing,

FIG. 2 is a graph showing the weight change in the contents of a vessel containing a high chromium iron and slag during refining in which control of the oxidation of chromium is performed in accordance with the technique of the present invention, and FIG. 3 for comparison to FIG. 2 is a graph showing the weight change in the contents of a vessel containing a charge similar to that used to construct FIG. 2, the control of the oxidation of chromium in this case being performed in accordance with the conventional technique of analysing samples taken during refining.

Referring to FIG. 1 a converter 1 is mounted on conventional right angled pedestals 2 which are pivotally connected at the outer extremity of their lower arms 3 to a pivotal mounting member 4. The upper arms 5 of the pedestals 2 are provided with bores in which are disposed the converter trunnions 6 which rest on bearings 7 (shown in broken line). The trunnions 6 are connected to a tiltable circular frame 8 upon which the converter 1 rests. The pedestals 2 themselves are supported on force transducers or load cells 9 which are located at the inner end of the lower arms 3. The arrangement of load cells 9 and the pivotal mounting enables the converter 1 to float freely so that the weight of the converter 1 and its contents can be measured via the load cells 9 and associated electrical bridge equipment (not shown).

The arrangement is similar to that shown in U.K. Pat. No. 1,373,652 and as in that arrangement the load cells 9 can be located within the bores between the bearings 7 and the pedestals 2 rather than underneath the pedestals 2.

The converter 1 is of the type where oxygen is injected through the top of the converter 1 via a lance (not shown) and the diluent gas (in this case argon) is injected into the bottom of the converter 1 via a pipe 10. The pipe 10 is supplied with the argon via the trunnion 5 which is hollow and which is connected to a union 11 into which argon issues from a supply pipe 12.

Referring to FIGS. 2 and 3, the weight records with respect to time of two melts of similar composition are shown. The initial charge weight in each case was 1150 Kg and this was taken as the mean weight shown as zero in FIGS. 2 and 3.

Referring to FIG. 2 the initial composition of the molten iron charge was 1.4% C, 0.045% P, 0.47% Si, 0.01% S, 0.80% Mn, 8.3% Ni, 17.4% Cr, the balance being iron, and incidental impurities. The charge was poured into a converter at a temperature of 1530° C. Oxygen was injected into the charge at 180 $m^3$/h through the top of the converter and air and nitrogen (the diluent gas) were injected through the base of the converter. The air flow through the pipe core was 35$m^3$/hour and the nitrogen flow rate through the pipe annulus was 8.5$m^3$/hour, that is, the initial ratio of oxygen: diluent gas was greater than 3:1.8 Kg of lime was added to the charge at the start of the blow.

During refining the weight of the vessel and its contents was continuously monitored and the weight changes occurring to the contents were plotted against time as shown in FIG. 2. It will be seen from FIG. 2 that apart from the initial increase in weight at the start of refining of about 12 Kg as oxygen was absorbed initially by the various elements of the charge e.g. iron, silicon, etc. the weight of the contents remained virtually constant until point A. This showed that the weight gain due to the oxidation of iron, silicon etc. which formed a slag was being balanced by the weight loss due to the evolution of carbon from the charge as CO and $CO_2$. At point A however which occurred some 9.4 minutes after the start of refining there was a sudden and dramatic increase in the weight of the vessel contents. This showed that virtually all the silicon had been oxidised and that now oxidation of chromium (forming an oxide in the slag) was proceeding at a rate exceeding that of carbon. An analysis of the melt at this stage produced the following results: 0.37% C, 0.042% P, 0.10% Si, 8.3% Ni, 0.44% Mn, 16.7% Cr, the balance being iron and incidental impurities. The temperature of the melt was 1730° C.

At point A the top lance was removed and subsequent stages were bottom blown. The gas mixture flow to the pipe core was 60$m^3$/hour oxygen and 21.5$m^3$/hour argon, with a further 8.5$m^3$/hour argon being blown through the pipe annulus to replace nitrogen. That is the ratio of oxygen: diluent gas was reduced to 2:1. This enabled the carbon and chromium oxidation rates to be balanced so that the weight of the vessel contents remained roughly constant until point B was reached when once again there was a sudden and dramatic increase in the weight of the vessel contents. This point occurred some 6.1 minutes after point A and showed that the rate of oxidation of chromium was now exceeding that of carbon. The analysis of the charge at this point showed the following: 0.12% C, 0.041% P, 0.04% Si, 0.36% Mn, 8.6% Ni, 16.2% Cr the balance being iron and incidental impurities.

At point B the oxygen rate was immediately reduced to 30 $m^3$/hour and the argon rate was increased to 60 $m^3$/hour that is the ratio of oxygen: diluent gas was reduced to 1:2, injection was continued for a further 6.1 minutes until the final carbon level was 0.03%, 20 Kg of Fe Si were added and the melt was stirred with argon at 28.5 $m^3$/hour for 5 minutes to recover chromium from the slag. The final composition was 0.03% C, 0.011% S, 0.04% P, 0.16% Si, 0.49% Mn, 8.5% Ni, 17.2% Cr and the balance iron at a temperature of 1650° C. The total loss in chromium to the slag was therefore only 0.2%.

This is significantly less than is at present obtainable with conventional techniques.

Referring to FIG. 3 the initial composition of the melt was 1.6% C, 0.01% S, 0.045% P, 0.28% Si, 0.81% Mn, 8.3% Ni, 17.8% Cr, the balance being iron and incidental impurities. The charge was poured into the converter at a temperature of 1520° C. The initial injection rates and ratios for oxygen air and nitrogen were the same as for the process described in relation to FIG. 2. This stage of the process was terminated at point A', 10.8 minutes after the start of refining, where the temperature of the melt was 1720° C. and the analysis was 0.27% C, 0.01% S, 0.06% Si, 0.33% Mn, 8.7% Ni, 17.1% Cr, the balance being iron and incidental impurities. The analysis thus indicated that the carbon content was approximately 0.30% and this was why the stage was terminated at this point. The oxygen: diluent gas (argon) ratio was then set at 2:1 and the injection rates were 60 $m^3$/hour and 30 $m^3$/hour respectively as in the process described in relation to FIG. 2. This stage of the process was terminated in line with conventional practice at point B' after a further 6.2 minutes when the analysis indicated that the carbon content of the melt was 0.10%, the temperature of the melt then being 1690° C. The analysis was in fact 0.10% C, 0.04% Si, 0.01% S, 0.18% Mn, 8.5% Ni, 15.7% Cr, the balance being iron and incidental impurities. The oxygen: argon ratio was then reduced to 1:2, the injection rates being respectively 30 $m^3$/hour and 60 $m^3$/h. The refining process was then finally terminated after a further 8 minutes and 20 Kg Fe/Si were added to the melt which was stirred with argon for 5 minutes at a rate of 28.5$m^3$/hour. The final analysis of the melt was 0.04% C, 0.01% S, 0.25% Si, 0.32% Mn, 8.9% Ni, 16.9% Cr the balance being iron and incidental impurities and the temperature of the melt was 1660° C. The total loss of chromium to the slag was thus 0.9% which is much higher than than obtainable with the process described in relation to FIG. 2. It will be seen from FIG. 3 that the reductions in the ratios of oxygen: diluent gas were both made after the sudden increase in the weight of the vessel contents when oxidation of chromium is occurring at an increasing rate and this explains why the loss of chromium in the conventional process is much higher than that in the process of the present invention. The great advantage of the present invention is that the correct points for reduction in the ratios can be instantly identified from FIG. 2.

More importantly however the points at which significant changes in weight occur indicate clearly the stages at which oxidation of carbon is slowing down and oxidation of chromium is increasing so that action can be taken instantly to rectify this situation and ensure preferential oxidation of carbon. The fact that the differential rates of chromium and carbon oxidation are measured directly enables the effects of temperature variations in the chemical equilibrium to be compensated for.

It will be appreciated that the invention has application to the refining of metals and alloys other than stainless steel such as non-ferrous metals like copper in which the impurity is sulphur, copper being the selected constituent element.

It will be further appreciated that the ratio of oxygen: diluent gas can be continuously varied during the whole of the refining process in accordance with the weight changes occurring in the vessel contents and this procedure would if optimised still further reduce oxidation of chromium. In this case of course it would be necessary to determine an optimum gas ratio for minimum chromium oxidation at selected periods during refining and relate this to the weight change graph for a melt of stainless steel.

While FIGS. 2 and 3 are plots of weight change against time, it will be appreciated that the weight changes at points A, A', B and B' are more clearly shown up if rate of weight change is plotted against time and where possible this is a recommended practice.

We claim:

1. A method for refining molten metal containing an impurity which is oxidisable in preference to at least one selected constituent element of the metal and which forms a gaseous oxide, the method comprising injecting oxygen and a diluent gas into the molten metal contained in a vessel so as to reduce the proportion of the impurity in the metal by evolution as the gaseous oxide, weighing the vessel during the refining to establish a point at which the weight of the vessel contents changes significantly due to the preferential oxidation of the at least one selected constituent element, initiating at the point a reduction in the ratio of oxygen: diluent gas so as to reduce the rate of oxidation of the at least one selected constituent element relative to the impurity and continuing injection until the proportion of the impurity is reduced to the desired level.

2. A method according to claim 1 in which the significant change in the weight of the vessel contents takes the form of a significant inflexion in the shape of the curve recording the weight of the vessel contents.

3. A method according to claim 1 in which the significant change in the weight of the vessel contents is established from a determination of the rate at which the weight of the vessel contents is changing.

4. A method according to claim 1 in which the vessel is weighed continuously during refining.

5. A method according to claim 1 in which during refining the reduction in the ratio of oxygen: diluent gas is continued as at least one further point representative of significant changes in the weight of the vessel contents is established.

6. A method according to claim 1 in which the reduction in the ratio of oxygen: diluent gas is continued until a final ratio is achieved.

7. A method according to claim 1 in which the molten metal is an alloy.

8. A method according to claim 7 in which the alloy is of high chromium iron destined to become stainless steel and the impurity is carbon, the at least one selected constituent element being chromium.

9. A method according to claim 8 in which the reduction in the ratio of oxygen: diluent gas is performed in two stages corresponding to two points at which sharp increases in the weight of the vessel contents are found to occur during refining.

10. A method according to claim 9 in which the initial ratio is at least 3:1 and is reduced in the first stage to an intermediate ratio 2:1.

11. A method according to claim 10 in which in the second stage the ratio is reduced from 2:1 to a final ratio of 1:2.

12. A method according to claim 9 in which the initial ratio is held constant during the initial refining period until the occurence of the first point at which a significant changes occurs in the weight of the vessel contents.

13. A method according to claim 1 in which the inert gas is an inert gas mixture.

14. A method according to claim 9 in which the inert gas is an inert gas mixture.

15. A method according to claim 1 in which the inert gas is one or a mixture of the following: — argon, nitrogen and steam.

16. A method according to claim 9 in which the inert gas is one or a mixture of the following: — argon, nitrogen and steam.

* * * * *